US006516922B2

(12) United States Patent
Shadkin et al.

(10) Patent No.: US 6,516,922 B2
(45) Date of Patent: Feb. 11, 2003

(54) SELF-GENERATING ELEVATOR EMERGENCY POWER SOURCE

(76) Inventors: Gregory Shadkin, 708 Lamon Ave., Wilmette, IL (US) 60091; Andrew Reisman, 1035 Hohlfelder Rd., Glencoe, IL (US) 60022

( * ) Notice: Subject to any disclaimer, the term of this patent is extended or adjusted under 35 U.S.C. 154(b) by 0 days.

(21) Appl. No.: 09/849,030

(22) Filed: May 4, 2001

(65) Prior Publication Data

US 2002/0162705 A1 Nov. 7, 2002

(51) Int. Cl.[7] ..... B66B 1/06
(52) U.S. Cl. ..... 187/290; 187/405
(58) Field of Search ..... 187/290, 296, 187/404, 405; 318/375, 376

(56) References Cited

U.S. PATENT DOCUMENTS 3,559,768 A * 2/1971 Cox ..... 187/257
4,307,793 A * 12/1981 Caputo ..... 187/297
4,642,474 A * 2/1987 Watanabe ..... 187/290
4,662,478 A * 5/1987 Uchino ..... 187/290
5,788,018 A * 8/1998 Mendelsohn et al. ..... 187/404
5,864,474 A * 1/1999 Jang ..... 187/296
5,894,910 A * 4/1999 Suur-Askola et al. ..... 187/290
5,945,644 A * 8/1999 Jang ..... 187/296
6,264,005 B1 * 7/2001 Kang et al. ..... 187/290
6,269,910 B1 * 8/2001 Fargo et al. ..... 187/287
6,325,179 B1 * 12/2001 Barreiro et al. ..... 187/393

OTHER PUBLICATIONS

OTIS Elevators, Glossary. www.otis.com/glossary/0,1374, cll1_RES1,00.html.*

* cited by examiner

*Primary Examiner*—Jonathan Salata
(74) *Attorney, Agent, or Firm*—Marshall J. Brown; Foley & Lardner

(57) ABSTRACT

An elevator system, elevator retrofit kit, and detachable counterweight for providing a self-generating elevator emergency power source. The system converts kinetic energy of an elevator cab descending due to gravity into electrical energy used to regulate the speed of descent. The elevator system can be structured in numerous ways and includes either a generator or a motor in generator mode, driven by a cable attached to the elevator cab and activated by the descent of the cab. The elevator cab descends due to gravity, either by using a counterweight being sufficiently light relative to the cab to cause the cab to descend, or by using a counterweight system whereby power loss or interruption causes the unlocking of a detachable counterweight from a permanent counterweight.

3 Claims, 3 Drawing Sheets

SELF-GENERATING ELEVATOR EMERGENCY POWER SOURCE

FIELD OF THE INVENTION

The present invention relates to a self-powered emergency descent system for elevator systems. More particularly, the present invention pertains to the use of the kinetic energy of an elevator cab descending due to gravitational forces to generate electrical energy to regulate the speed of descent to the ground level or any other assigned floor located below the elevator cab.

BACKGROUND OF THE INVENTION

Elevator systems and controls for such systems are known in the art. Such systems and controls use a wide variety of designs to achieve numerous objectives, and the basic principle of balancing an elevator cab against a counterweight via a cable and sheave assembly driven by a motor is known to those skilled in the art.

For years, building designers and code authorities have recognized the necessity of emergency power in buildings to ensure that elevator cabs descend to the ground level in the event of power loss due to a building fire or any other reason. Without an independent source of power for the elevator system, any power outage could compromise the safety of passengers in the elevator cab.

Various approaches have been described in the prior art for providing emergency power for elevator systems. Many of these devices have been subject to a range of difficulties and disadvantages. For example, batteries sufficiently powerful to drive an elevator or multiple elevators typically are large, expensive, require invertors, and require extensive maintenance. Similarly, fossil fuel driven generators are large, expensive, and require extensive maintenance and testing. In many buildings, finding a desirable location for the installation of emergency back up systems with large footprints represents a significant engineering challenge. Moreover, most elevator systems currently require building power distribution systems to provide transfer switches and emergency feeders for elevators and main distribution emergency switchboards and emergency generators sufficiently large to cover elevator loads, all of which result in additional costs and inefficiencies.

Thus, it would be advantageous to have an elevator system that during a power outage or any other occasion when needed accomplishes the controlled descent of the elevator cab without a battery or fossil fuel based generator to drive the elevator motor, but rather accomplishes the initial descent of the elevator cab due to gravitational forces and the heaviness of the elevator cab relative to an attached counterweight, and which then converts kinetic energy of the descending elevator cab into electrical energy used to control the speed of descent of the elevator cab.

SUMMARY OF THE INVENTION

The invention provides for an elevator system, detachable counterweight, and an elevator system upgrade kit that provides a self-generating emergency power source for elevators by converting the kinetic energy of the elevator cab descending due to gravitational forces and the heaviness of the cab relative to the attached counterweight, into electrical energy used to regulate the speed of descent to the ground level or any other assigned floor located below the elevator cab. The elevator system includes either a generator or a motor operating in generator mode that is driven by a descending elevator cab. The elevator system accomplishes the initial descent of the elevator cab during a power outage, or otherwise when needed, by either (1) using a counterweight that is sufficiently lighter than the elevator cab to cause the cab to descend due to its relative heaviness, or (2) due to a locking system joining a detachable counterweight to a permanent counterweight whereby power loss or interruption causes the unlocking of the detachable counterweight from the permanent counterweight and thereby resulting in the descent of the elevator cab due to its heaviness relative to the permanent counterweight. The elevator upgrade kit operates in a similar way, but includes the modification of the counterweights and generators or motors in existing elevator systems. In elevator systems in which a braking system is activated by an outside power loss, an elevator controller with a small battery back-up directs the brakes to release after a preset time and remain released while the elevator cab accomplishes its descent. The kinetic energy represented by the raised elevator cab is the source of emergency power for the elevator system. When gravitational forces cause the elevator cab to descend, an attached generator or motor in generator mode driven by the descending elevator cab converts the kinetic energy into electrical energy to control the descent of the elevator cab.

It is therefore an object of the invention to provide an improved elevator system and an elevator upgrade kit so designed that the kinetic energy of the descending elevator cab can be used to generate its own emergency power for a regulated speed of descent to the ground level or any other floor located below the elevator cab.

It is another object of the present invention to provide an improved elevator system and an elevator upgrade kit that provides an emergency power source for elevators more reliable than conventional elevator emergency power sources.

It is still another object of the present invention to provide an improved elevator system and elevator upgrade kit that provides an independent reliable emergency power source to drive an elevator cab down with a controlled speed of descent to evacuate passengers to a safe area during a fire or power outage.

It is still another object of the present invention to provide an improved elevator system and elevator upgrade kit that provides an emergency power source for elevators that eliminates the need for building power distribution systems to provide transfer switches and emergency feeders for elevators.

It is still another object of the present invention to provide an improved elevator system and elevator upgrade kit that provides an emergency power source for elevators that allows for reductions in the size of main distribution emergency switchboards and emergency generators because those devices no longer would need to cover elevator loads.

It is finally another object of the present invention to provide an improved elevator system and elevator upgrade kit that achieves the efficiencies of a well-balanced counterweight to elevator cab ratio, while allowing for the elevator cab to descend and thereby convert its kinetic energy into electrical energy upon the detachment of the detachable counterweight from the permanent counterweight.

Further advantages and features of the present invention will be apparent from the foregoing specification and claims once considered in connection with the accompanying drawings illustrating the preferred embodiment of the invention.

BRIEF DESCRIPTION OF THE DRAWINGS

The invention and the preferred modes of use will best be understood by reference to the following detailed description of an illustrative embodiment when read in conjunction with the accompanying drawings, wherein.

DETAILED DESCRIPTION OF THE PREFERRED EMBODIMENT

The present invention is based on utilizing the kinetic energy of an elevator cab descending due to the difference between the weight of the elevator cab and the weight of the counterweight as a braking energy to achieve a controllable speed of descent to a preset or selected floor. The descending elevator cab attached to a mechanical system of shafts and pulleys drives either a separate generator or an elevator motor operating in generating mode, converting the kinetic energy of the descending elevator cab into electrical energy. The torque (opposed torque) generated by a separate generator or elevator motor in generating mode is directed against torque produced by descending elevator cab and when controlled, a controllable speed of descent to a preset or selected floor can be achieved. The opposed torque is controlled by a dedicated controller regulating the electrical current of the generator or motor in generating mode as a function of the elevator cab weight, the number of passengers in the elevator cab, desirable acceleration, speed of descent and deceleration before final stop. When using a detachable counterweight, after descent of the elevator cab and when normal conditions in the building are restored, the operator raises the elevator cab and thereby lowers the permanent counterweight until the permanent counterweight engages the detachable counterweight and the electrically held release lock mechanism automatically locks. If one uses for an elevator a permanent counterweight that is lighter than the elevator cab, the elevator system will return to normal operation upon restoration of power without the need for operator involvement. The self-generating emergency power source can be used in new elevator installations or can be installed as a retrofit to existing elevators.

Figure 1:
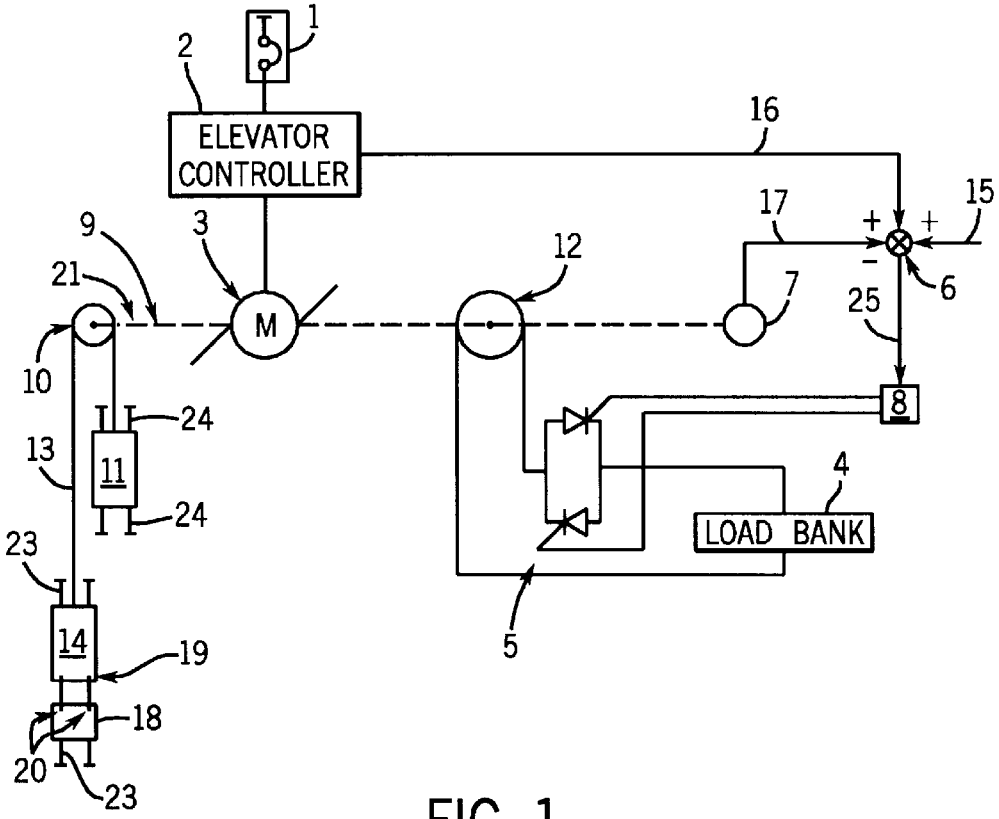
FIG. 1 is a control block diagram of a self-generating elevator emergency power source for an elevator system using a detachable counterweight and an electrical generator.

Referring now to the figures, FIG. 1 shows a preferred embodiment of a self-generating elevator emergency power source in which detachment of a detachable counterweight 18 causes an elevator cab 11 to descend, thereby driving an electrical generator 12 which provides braking power for a controlled speed of descent to a preset or selected floor, comprising: an a building distribution system electrical supply panel 1, an elevator controller 2 with an integral battery to support control during power loss or interruption, an electrical drive motor 3, a load bank 4, a thiristor or transistor switch 5 or similar operative device, a summing device 6 to sum all control signals and to generate a resultant control signal 25, a tachogenerator speed feedback device 7, a dedicated emergency descent controller 8 with pulsewidth modulation (PWM) output, a mechanical system of shafts and pulleys 9 and 10 respectively, an elevator cab 11, an alternating or direct current electrical generator 12, a cable 13, a permanent counterweight 14, a detachable counterweight 18, electrically held spring release locks 19, detachable counterweight free fall catchers 20, elevator brakes 21, a counterweight rail system 23, and an elevator cab rail system 24.

The elevator controller 2 with an integral battery to support control during power loss receives power from a building distribution system via the electrical power supply panel 1. The elevator controller 2 drives the elevator drive motor 3. The elevator drive motor 3 is connected to the elevator cab 11 via the mechanical system of shafts and pulleys 9 and 10 and drives the elevator cab 11 up and down guided by the elevator cab rail system 24. The elevator controller 2 also is connected to electrically held spring release locks 19. The bottom part of the spring release locks release locks 19 is coupled to the detachable counterweight 18, and the top part of the spring release locks 19 is coupled to the permanent counterweight 14, such that when the permanent counterweight 14 and detachable counterweight 18 come together the locking mechanisms of the spring release locks 19 on each of the two counterweights 14 and 18 engage and thereby join the permanent counterweight 14 and detachable counterweight 18 together to act as a single counterweight. Both the permanent counterweight 14 and the detachable counterweight 18 are guided by a counterweight rail system 23. Free fall catchers 20 are coupled to the detachable counterweight 18. When the spring release locks 19 are engaged during normal operation, the spring release locks 19 lock the permanent counterweight 14 to the detachable counterweight 18, comprising the total weight offsetting the weight of the elevator cab 11 through the connecting cable 13 and counterweight pulley 10 system.

When the elevator controller 2 senses a power loss in the electrical supply panel 1, the elevator controller 2 cuts off control voltage to the electrically held spring release locks 19, causing the spring release locks 19 to disengage the detachable counterweight 18 from the permanent counterweight 14. Upon detachment, the detachable counterweight 18 descends under its own weight until the speed of the detachable counterweight 18 exceeds a preset value, at which point the free fall catchers 20 stop the descent of the detachable counterweight 18 by clamping onto the counterweight rail system 23. The elevator controller 2 is also connected to the elevator brakes 21, and when the elevator controller 2 senses a power loss in the electrical supply panel 1, the elevator controller 2 causes the elevator brakes 21 to be released and held in a released position.

Due to the heavier weight of the elevator cab 11 relative to the permanent counterweight 14, and due to the elevator brakes 21 being held in the released position, the elevator cab 11 begins descending under its own weight after detachment of the detachable counterweight 18. The descending elevator cab 11 is connected to the alternating or direct current electrical generator 12 through the cable 13, and mechanical system of shafts and pulleys 9 and 10 respectively, and the descent of the elevator cab 11 thereby causes the cable 13 to rotate the counterweight pulley 10, thereby through the mechanical system of shafts and pulleys 9 driving the electrical generator 12. The alternating or direct current generator 12 is connected to the load bank 4 via the thiristor or transistor switch 5 or similar operative device. The dedicated emergency descent controller 8 with pulsewidth modulation (PWM) output is connected to the thiristor or transistor switch 5 or similar operative device, and thereby regulates the generator current through the load bank 4.

The regulated generator current produces regulated generator torque directed against the torque of the descending elevator cab 11, maintaining a controlled speed of descent. As part of the elevator control system, a speed negative feedback signal 17 from the tachogenerator 7, a reference control signal 15, and a control signal 16 from the elevator controller 2 that directs the elevator cab 11 to begin its descent, are all processed by the summing device 6. The summing device 6 generates a resultant control signal 25 to maintain a constant speed of descent of the elevator cab 11 as a function of cab weight, preset speed of descent, and cab acceleration and deceleration before final stop. Although FIG. 1 depicts the summing device 6 and its related signals as separate from the dedicated emergency descent controller 8 with pulsewidth modulation (PWM) output, the summing device 6 and its related signals can be part of the dedicated emergency descent controller 8.

After normal power is restored, the elevator controller 2 directs the elevator drive motor 3 to rotate the counterweight pulley 10 to raise the elevator cab 11 and correspondingly cause the attached permanent counterweight 14 to descend until the top half of the release locks 19 coupled to the bottom of the permanent counterweight 14 engages the top half of the release locks 19 coupled to the top of the detachable counterweight 18, at which point the release locks 19 engage and thereby couple the permanent counterweight 14 to the detachable counterweight 18, restoring the elevator system to normal operation.

Figure 2:
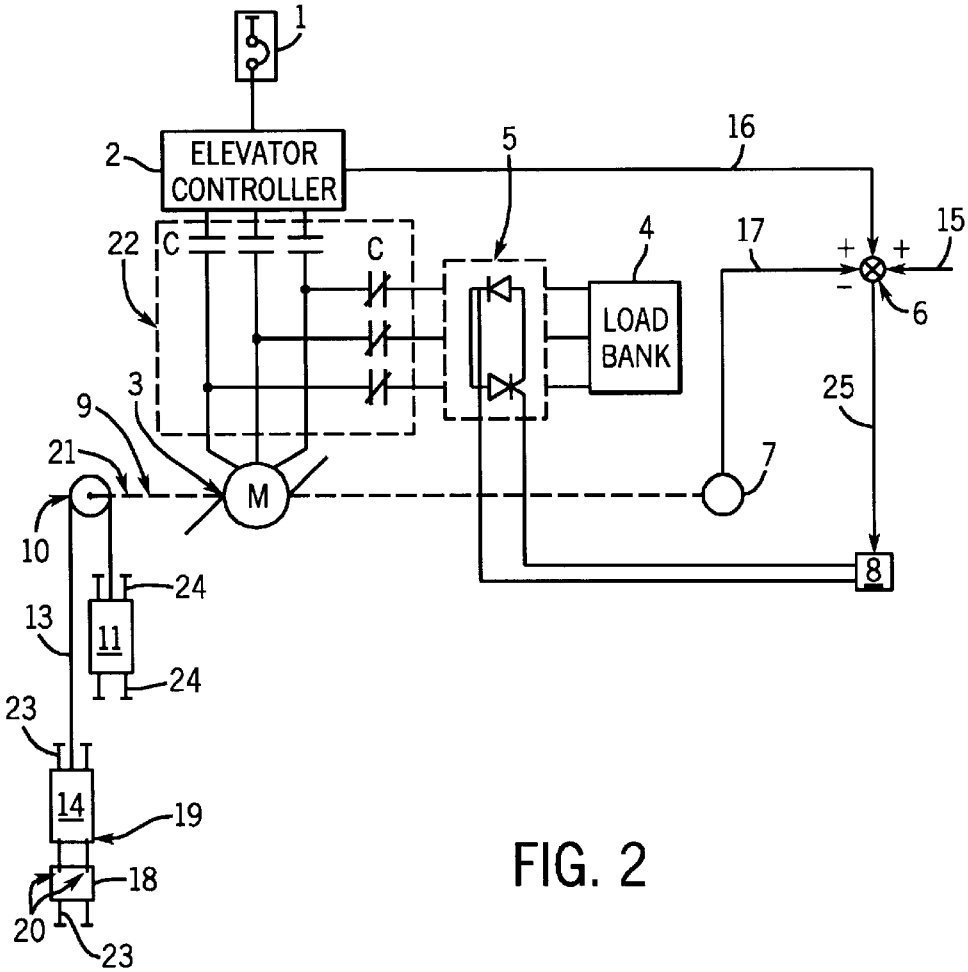
FIG. 2 is a control block diagram of self-generating elevator emergency power source for an elevator system using a detachable counterweight and an elevator motor in generator mode.

In an alternative embodiment shown in FIG. 2, an elevator system, instead of using the electrical generator 12 of FIG. 1 to generate electrical energy during power loss or interruption, the system uses the elevator drive motor 3 with a motor mode operation switching contactor 22. The elevator controller 2 is connected to the motor mode operation switching contactor 22. Upon sensing power loss or interruption, the elevator controller 2 directs the motor mode operation switching contactor 22 to disconnect the elevator drive motor 3 from the elevator controller 2 and connects the elevator drive motor 3 to a load bank 4 through a thiristor or transistor switch 5 or similar operative device. The descending elevator cab 11 is connected to the elevator drive motor 3 through the cable 13 and mechanical system of shafts and pulleys 9 and 10 respectively, and the descent of the elevator cab 11 thereby causes the cable 13 to rotate the counterweight pulley 10, thereby through the mechanical system of shafts and pulleys 9 and 10 respectively, driving the elevator drive motor 3 as a generator. The output of the electrical drive motor 3 as a generator is connected to a load bank 4 via a thiristor or transistor switch 5 or similar operative means. The elevator system otherwise operates in a similar manner to the elevator system of FIG. 1.

Figure 3:
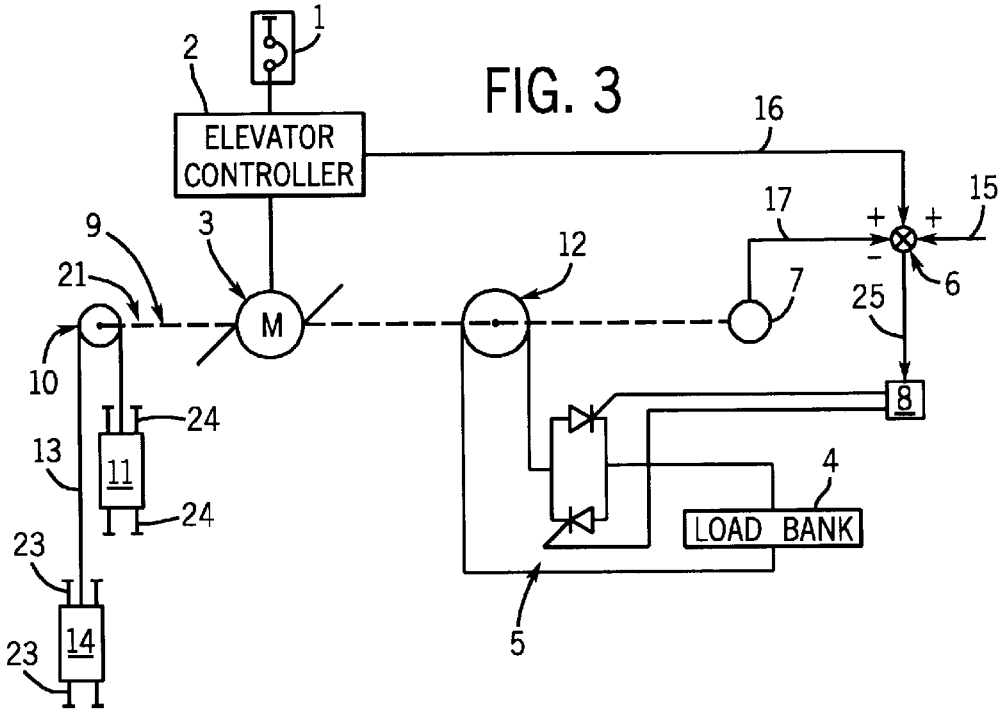
FIG. 3 is a control block diagram of self-generating elevator emergency power source for an elevator system using an elevator cab heavier than a permanent counterweight, and an electrical generator.

In an additional embodiment as shown in FIG. 3, the elevator system is similar to the system of FIG. 1, except that rather than using the detachable counterweight 18 with release locks 19 and free fall catchers 20, a permanent counterweight 14 that is lighter than the elevator cab 11 is used. Therefore when the elevator controller 2, after sensing power loss, directs that the elevator brakes 21 release and be held in a released position, the elevator cab 11 begins descending due to its heaviness relative to the permanent counterweight 14. The elevator system otherwise operates in a manner similar to the elevator system of FIG. 1.

Figure 4:
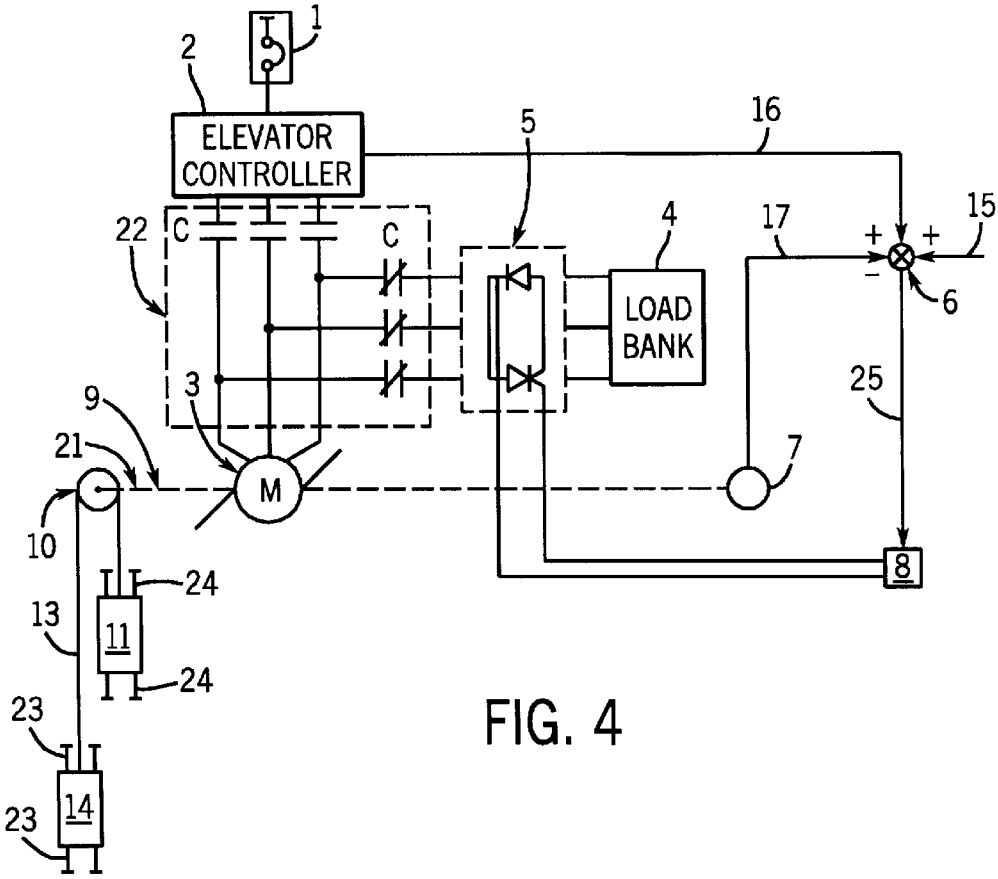
FIG. 4 is control block diagram of self-generating elevator emergency power source for an elevator system using an elevator cab heavier than a permanent counterweight, and an elevator motor in generator mode.

In an alternative embodiment as shown in FIG. 4, an elevator system, instead of using the electrical generator 12 of FIG. 2 to generate electrical energy during power loss or interruption, uses the elevator drive motor 3 with a motor mode operation switching contactor 22. Further, rather than using the detachable counterweight 18 with release locks 19 and free fall catchers 20, the system uses the permanent counterweight 14 that is lighter than the elevator cab 11 so that when the elevator controller 2 after sensing power loss directs that the elevator brakes 21 release and be held in a released position, the elevator cab 11 begins descending due to its heaviness relative to the permanent counterweight 14.

In another embodiment of the invention, a retrofit kit can be installed in an existing elevator systems to accomplish an elevator system according to FIG. 1. The retrofit kit is comprised of a replacement counterweight consisting of a permanent counterweight 14 joined to a detachable counterweight 18 with free fall catchers 20 through electrically held spring release locks 19 or other like devices. The top half of the spring release locks 19 is coupled to the bottom of the permanent counterweight 14, and the bottom half of the spring release locks 19 is coupled to the top of the detachable counterweight 18. The retrofit kit includes a small battery for the elevator controller 2 to support control during power loss, which battery is integral to the elevator controller 2. The retrofit kit further includes an alternating or direct current electrical generator 12, the output of which is connected to the load bank 4 via the thiristor or transistor switch 5 or similar operative device. The retrofit kit includes a dedicated emergency descent controller 8 with pulsewidth modulation (PWM) output connected to the thiristor or transistor switch 5 or similar operative device, which thereby regulates the generator current through the load bank 4. A summing device 6 is attached to the elevator controller 2 and the tachogenerator 7. The summing device 6 process the speed negative feedback signal 17 from the tachogenerator 7, the reference control signal 15, and the control signal 16 from the elevator controller 2 that directs the elevator cab 11 to begin its descent. The summing device 6 then generates the resultant control signal 25 to maintain a constant speed of descent of the elevator cab 11 as a function of cab weight, preset speed of descent, and cab acceleration and deceleration before final stop. Although FIG. 2 depicts the summing device 6 and its related signals as separate from the dedicated emergency descent controller 8 with pulsewidth modulation (PWM) output, the summing device 6 and its related signals can be part of the dedicated emergency descent controller 8. When installed, the retrofit kit functions in a manner consistent with the elevator system described in FIG. 1.

In an alternative embodiment, a retrofit kit can be installed in existing elevator systems to accomplish an elevator system according to FIG. 2. A difference between the elevator retrofit kit based upon FIG. 2 and the elevator retrofit kit based upon FIG. 1 is that instead of being comprised of the electrical generator 12 to generate electrical energy during power loss or interruption, the retrofit kit is comprised of the elevator drive motor 3 with the motor mode operation switching contactor 22. When installed, the retrofit kit functions in a manner consistent with the elevator system described in FIG. 2.

In yet an another embodiment, a retrofit kit can be installed in existing elevator systems to accomplish an elevator system according to FIG. 3. A difference between this retrofit kit and the retrofit kit in accordance with FIG. 1 is that rather than using the detachable counterweight 18 with release locks 19 and free fall catchers 20, the retrofit kit of FIG. 3 uses a permanent counterweight 14 that is lighter than the elevator cab 11 so that when the elevator controller 2 after sensing power loss directs that the elevator brakes 21 release or remain released, the elevator cab 11 begins descending due to its heaviness relative to the permanent counterweight 14. When installed, this retrofit kit functions in a manner consistent with the elevator system described in FIG. 3.

In still another embodiment, a retrofit kit can be installed in existing elevator systems to accomplish an elevator system according to FIG. 4. The FIG. 4 retrofit kit is similar to the retrofit kit based upon FIG. 3, except that instead of being comprised of the electrical generator 12 to generate electrical energy during power loss, the retrofit kit comprises an elevator drive motor 3 with a motor mode operation switching contactor 22. When installed, the retrofit kit functions in a manner consistent with the elevator system described in FIG. 4.

In yet another embodiment, a counterweight device is comprised of the permanent counterweight 14 and the detachable counterweight 18 with free fall catchers 20, the permanent counterweight 14 and detachable counterweights 18 being coupled together by electrically held spring release locks 19 or other like devices when the locks are engaged. The bottom part of the spring release locks 19 is coupled to the detachable counterweight 18, and the top part of which spring release locks 19 is coupled to a permanent counterweight 14. When the permanent counterweight 14 and detachable counterweight 18 come together, the locking mechanisms of the spring release locks 19 on each of the two counterweights engage and thereby join the permanent counterweight 14 and detachable counterweight 18 together to act as a single counterweight. Both the permanent counterweight 14 and the detachable counterweight 18 are guided by the counterweight rail system 23. Free fall catchers 20 are coupled to the detachable counterweight 18. A power loss to the electrically held spring release locks, whether by direction of an elevator controller or otherwise, causes the spring release locks 19 to disengage. Upon detachment, the detachable counterweight 18 descends under its own weight until the speed of the detachable counterweight 18 exceeds a preset value, at which point the free fall catchers 20 stop the descent of the detachable counterweight 18 by clamping onto the counterweight rail system 23. After return of normal power and upon the permanent counterweight 14 being lowered to the detachable counterweight 18, or upon the detachable counterweight 18 being raised to the permanent counterweight 14, the electrically held spring release locks 19 engages and thereby couples the permanent counterweight 14 to the detachable counterweight 18.

Although the invention has been described with reference to specific embodiments, this description is not meant to be construed in a limiting sense. Various modifications of the disclosed embodiments as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An emergency descent system for elevators using gravitational forces to control the descent of an elevator cab in the event of a loss of power from an outside power source, the system comprising:

a counterweight assembly including a counterweight weighing less than the minimum weight of the elevator cab;

a generating unit operatively coupled to a drive member and electrically coupled to a load bank;

a cable having a first end and second end, the cable operatively coupled to the drive member between the first end and second end, the first end coupled to the counterweight assembly and the second end coupled to the elevator cab such that the weight differential between the counterweight assembly and the elevator cab causes the drive member to rotate, causing the generating unit to produce a first generator torque and a corresponding first current; and an elevator controller having a secondary power source to supply power to the elevator controller, the elevator controller electrically coupled to an outside power source, the secondary power source, the generating unit, and the load bank, wherein the elevator controller configured to detect the speed of the elevator cab and direct a current from the generator to the load bank, and wherein the regulated current produces a generator torque to counteract the cab torque for controlling the rotation of the drive member and the descent of the elevator cab, and wherein the counterweight assembly includes a constant counterweight weighing less than the minimum weight of the elevator cab, a detachable counterweight, and a releasable lock, the constant counterweight coupled to the first end of the cable and the detachable counterweight releasably coupled to the constant counterweight through the releasable lock, and wherein the elevator controller is electrically coupled to the releasable lock and is configured to send a release signal to the releasable lock upon a loss of outside power.

2. The emergency descent system of claim 1, further comprising a free-fall catcher connected to the detachable counterweight and configured for clamping to the counterweight rail upon a substantially free-fall descent.

3. The emergency descent system of claim 1, wherein upon the restoration of outside power, the elevator controller directs the elevator cab to rise and the constant counterweight to correspondingly lower into contact with the detachable counterweight, wherein the releasable lock is configured to couple the constant counterweight and the detachable counterweight.

* * * * *